US005780792A

United States Patent [19]

Fritts et al.

[11] Patent Number: 5,780,792

[45] Date of Patent: Jul. 14, 1998

[54] INTERLOCK SWITCH FOR APPLIANCES

[75] Inventors: Rex E. Fritts; John D. Robeson, both of Cedar Rapids; Randy J. Furler, South Amana, all of Iowa

[73] Assignee: Amana Company L.P., Amana, Iowa

[21] Appl. No.: 668,193

[22] Filed: Jun. 21, 1996

[51] Int. Cl.[6] ..... H01H 9/22; H01H 5/00; H01H 9/20; H01H 3/16

[52] U.S. Cl. ..... 200/50.02; 200/50.12; 200/50.3; 200/61.62

[58] Field of Search ..... 200/50.02, 50.1, 200/50.12, 50.14, 50.3, 61.62, 61.76–61.82

[56] References Cited

U.S. PATENT DOCUMENTS

| | | | |
|---|---|---|---|
| 3,967,088 | 6/1976 | Horiuchi | 200/50 A |
| 4,054,769 | 10/1977 | Anderson et al. | 219/10.55 |
| 4,117,294 | 9/1978 | Appelquist et al. | 200/52 A |
| 4,277,659 | 7/1981 | Deremer | 200/61.62 |
| 4,516,007 | 5/1985 | Ringdahl et al. | 200/50 A |
| 4,529,852 | 7/1985 | Lewandowski | 200/50 A |
| 4,917,414 | 4/1990 | Boulanger | 292/98 |
| 5,235,150 | 8/1993 | Buske et al. | 219/10.55 R |
| 5,624,098 | 4/1997 | McDowell | 248/550 |

*Primary Examiner*—Edward Tso
*Assistant Examiner*—Bao Q. Vu
*Attorney, Agent, or Firm*—Marshall, O'Toole, Gerstein, Murray & Borun

[57] ABSTRACT

An electrical appliance includes an appliance base, a cover, power lines carrying electrical power to the appliance base, an interlock switch, and a fastener. The interlock switch has a switch case and a switch within the switch case. The switch case is affixed to the appliance base, the switch is in one of the power lines, and the switch has an open position and a closed position. The fastener is arranged to fasten the cover to the appliance base so that the fastener holds the switch in its closed position when the cover is fastened by the fastener to the appliance base and allows the switch to move to its open position when the cover is not fastened by the fastener to the appliance base.

35 Claims, 5 Drawing Sheets

INTERLOCK SWITCH FOR APPLIANCES

FIELD OF THE INVENTION

The present invention is directed to an interlock switch which disables power to an appliance when the cover of the appliance is removed in order to thereby reduce the likelihood of electric shock.

BACKGROUND OF THE INVENTION

Many appliances, such as microwave ovens, require high voltage alternating current for their operation. When such an appliance is serviced or repaired, a cover of the appliance is typically removed which often permits access to exposed electric terminals. If the exposed electric terminals are live, a potential shock hazard exists. Therefore, before removal of an appliance's cover, it is usual practice to interrupt power to the appliance by unplugging the power cord of the appliance or by opening a circuit breaker or removing a fuse in the electric lines which supply electric power to the power cord of the appliance.

Prior attempts to lessen the likelihood of a shock hazard in the event that the cover of an electric appliance is removed without interrupting power to the appliance have primarily focussed on insulating the otherwise live exposed terminals or in providing interlock switches which interrupt electric power to the appliance when its cover is removed. Insulating terminals is not a particularly satisfactory solution because the insulation may be improperly applied and/or because the insulation may deteriorate through use of the appliance. Prior interlock switches have not been particularly satisfactory because they have been relatively easy for an inexperienced user to override after the appliance's cover has been removed from the appliance.

The present invention is directed to an interlock switch for an appliance which is relatively more difficult to override than prior known interlock switches.

SUMMARY OF THE INVENTION

According to a first aspect of the present invention, an interlock switch, which opens when an appliance cover is removed, comprises a switch and a fastening means.

The switch is arranged to control power to an appliance. The fastening means fastens a cover to the appliance, holds the switch closed when the cover is fastened by the fastening means to the appliance, and allows the switch to open when the cover is unfastened from the appliance.

According to another aspect of the present invention, an electrical appliance comprises an appliance base, a cover, power lines, a switch case, a switch, and a fastener. The power lines carry electrical power to the appliance base. The switch case is affixed to the appliance base. The switch is within the switch case, the switch is arranged to control the electrical power carried by the power lines, and the switch has an open position and a closed position. The fastener is arranged to fasten the cover to the appliance base so that the fastener holds the switch in its closed position when the cover is fastened by the fastener to the appliance base and allows the switch to move to its open position when the cover is not fastened by the fastener to the appliance base.

According to yet another aspect of the present invention, an interlock switch, which opens when an appliance cover is removed, comprises a switch case, a switch, an actuator, and a fastener. The switch case has a fastener opening. The switch is within the switch case, the switch has an open position and a closed position, and the switch is arranged to supply power to an appliance when the switch is in its closed position. The actuator is within the switch case, the actuator is arranged to control the switch, and the actuator is not viewable through the fastener opening when the switch is in its open position. The fastener is arranged to operate the actuator through the fastener opening in order to hold the switch in its closed position when the fastener fastens a cover to an appliance base, and the actuator is arranged to allow the switch to move to its open position when the fastener is removed from the fastener opening.

BRIEF DESCRIPTION OF THE DRAWINGS

These and other features and advantages of the present invention will become more apparent from a detailed consideration of the invention when taken in conjunction with the drawings in which.

DETAILED DESCRIPTION

Figure 1:
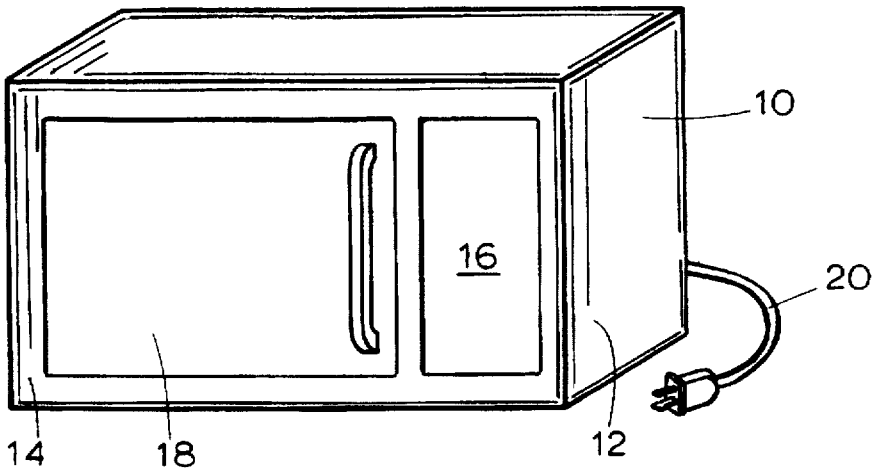
FIG. 1 is an isometric view of an appliance which may incorporate the present invention.

FIG. 1 illustrates a microwave oven 10 in which the present invention may be used. However, it should be understood that the present invention is useful in other types of electrical appliances such as refrigerators, ranges, laundry machines, heating and cooling products, televisions, computers, VCRs, power tools, etc., and may be used in conjunction with commercial, consumer, and/or industrial equipment.

The microwave oven 10 has a cabinet 12. A front face 14 of the cabinet 12 has a control area 16 which may provide various controls, such as time and temperature controls, that are accessible to a user. The front face 14 of the cabinet 12 also has a door 18 which permits access to the cooking area within the cabinet 12 of the microwave oven 10. The microwave oven 10 further has a power cord 20 which may be plugged into an electrical outlet in order to supply electrical power to the radiant energy emitters and control circuits of the microwave oven 10.

Figure 2:
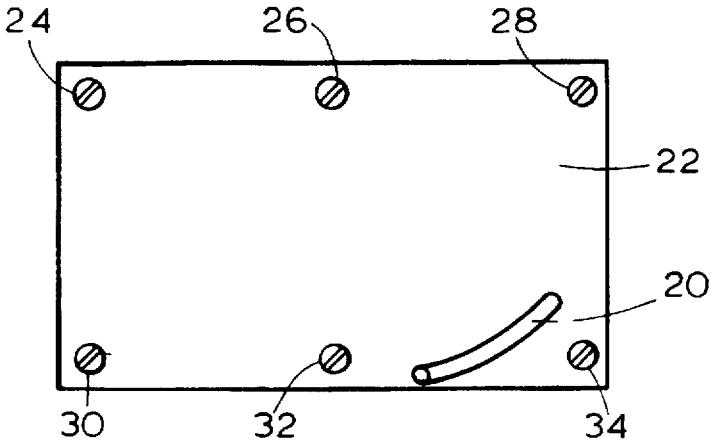
FIG. 2 is a back view of the appliance shown in the appliance shown in FIG. 1.
Figure 3:
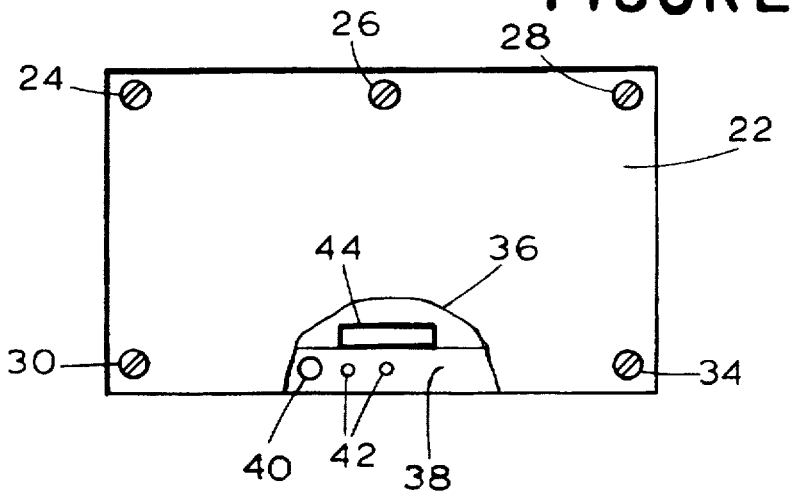
FIG. 3 is a back view of the appliance shown in FIG. 2 with the cover of the appliance being partially cut away to reveal an interlock switch according to the present invention.

As shown in FIG. 2, the microwave oven 10 includes a cover 22 which may be in the form of a back cover and which is attached to the cabinet 12 by a plurality of fasteners 24–34. As shown in FIG. 3, a portion of the cover 22 is broken away at a segment 36 in order to reveal a portion 38 of the cabinet 12. The portion 38 of the cabinet 12 has a fastener receiving hole 40 therethrough for receiving the fastener 32. Likewise, the cabinet 12 has other holes (not shown) corresponding to the other fasteners 24, 26, 28, 30, and 34. Rivets 42 (or other fasteners) attach a switch case 44 to the portion 38 of the cabinet 12. The switch case 44, for example, may be a substantially closed switch case and may be a metal box holding an interlock switch and its actuator to be described hereinafter.

Figure 4:
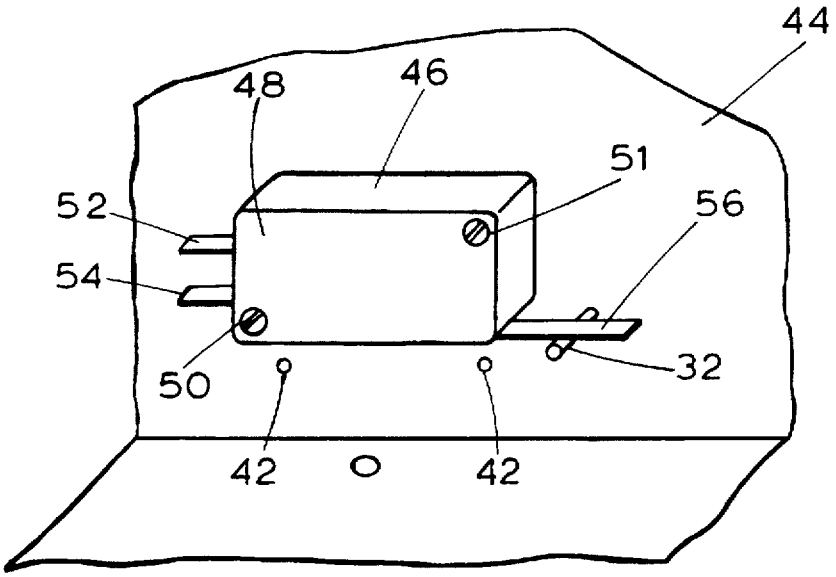
FIGS. 4 and 5 show the interlock switch of FIG. 3 in accordance with a first embodiment of the present invention.

As shown in FIG. 4, the switch case 44 is broken away in order to reveal an interlock switch 46 which has a switch housing 48 attached to the switch case 44 by suitable means such as fasteners 50 and 51. The interlock switch 46 has a pair of input terminals 52 and 54 which are connected into at least one of the power lines of the power cord 20. The interlock switch 46 may also have a ground connection (not shown) for a ground lead of the power cord 20. The interlock switch 46 has switch contacts for controlling the supply of power through at least one of the power lines of the power cord 20. The interlock switch 46 also has a switch actuator 56 which, as shown in FIG. 4, is in a position to close the switch contacts of the interlock switch 46. The switch actuator 56 is held in its switch closing position by the fastener 32 which extends through the fastener receiving hole 40 in the portion 38 of the cabinet 12 and through a corresponding hole 57 in the switch case 44.

Figure 5:
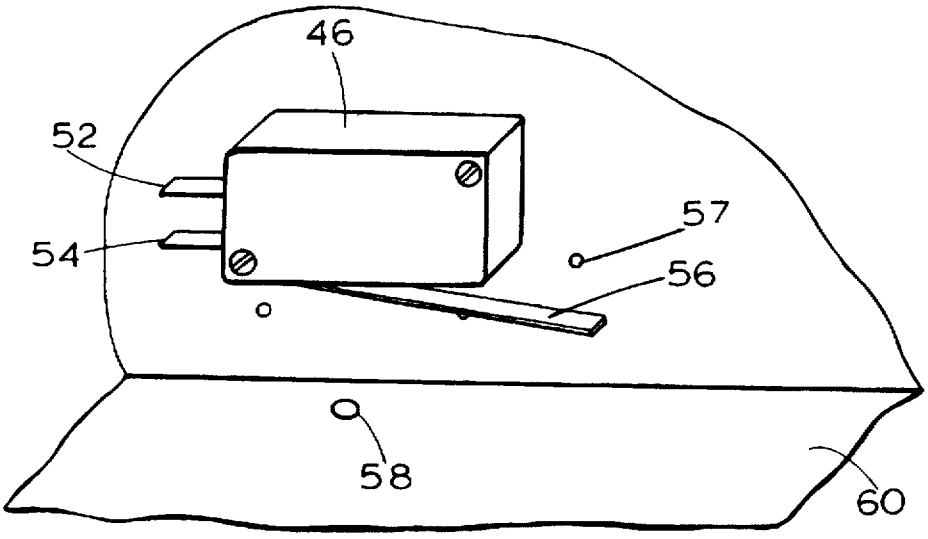

As shown in FIG. 5, when the cover 22 is unfastened from the cabinet 12, the fastener 32 is removed. Similarly, the other fasteners 24, 26, 28, 30, and 34 are also removed when the cover 22 is removed from the cabinet 12. When the fastener 32 is unfastened, the switch actuator 56 of the interlock switch 46 is allowed to drop into its switch opening position. When the switch actuator 56 of the interlock switch 46 drops into its switch opening position, the contacts of the interlock switch 46 open thereby cutting power to the control circuits and loads of the microwave oven 10. For example, the contacts in the switch housing 48 may be biased by a spring toward an open position so that, when the switch actuator 56 drops to its switch opening position, the spring forces the switch contacts of the interlock switch 46 to open. Accordingly, the switch actuator 56 permits the interlock switch 46 to open in order to disconnect power between the power cord 20 and the microwave oven 10.

Furthermore, when the switch actuator 56 drops to its switch opening position, the switch actuator 56 drops far enough below the fastener receiving hole 40 in the portion 38 of the cabinet 12 and below the corresponding hole 57 in the switch case 44 that the switch actuator 56 is not practically viewable by a user through the fastener receiving hole 40.

When the microwave oven 10 has been serviced and/or repaired and the cover 22 is to be reattached to the cabinet 12, a tool may be inserted through a hole 58, which extends through a floor 60 of the switch case 44, and a corresponding hole in the cabinet 12 of the microwave oven 10 in order to drive the switch actuator 56 back up to its switch closing position. While this tool holds the switch actuator 56 in this position, the fastener 32 is reapplied through the cover 22 and the switch case 44 in order to fasten the cover 22 to the cabinet 12. When the fastener 32 has been fully applied, the fastener 32 now holds the switch actuator 56 in its switch closing position as shown in FIG. 4 so that power is again available for the microwave oven 10. The other fasteners 24-30 and 34 are also reapplied to refasten the cover 22 to the cabinet 12.

Thus, because the interlock switch 46 is housed in a switch case which is substantially closed, it is difficult for the inexperienced user to see well enough into the switch case 44 in order to determine how to close the interlock switch 46 while the cover 22 is removed from the microwave oven 10. Moreover, because the switch actuator 56 is not viewable through the fastener receiving hole 40 and the corresponding hole 57, it is difficult for the inexperienced user to discern that the removal of the fastener 32 has opened the interlock switch 46 and cut power to the microwave oven 10. For these reasons, it is difficult for the inexperienced user to determine how to close the interlock switch 46 while the cover 22 is removed from the microwave oven 10.

Figure 6:
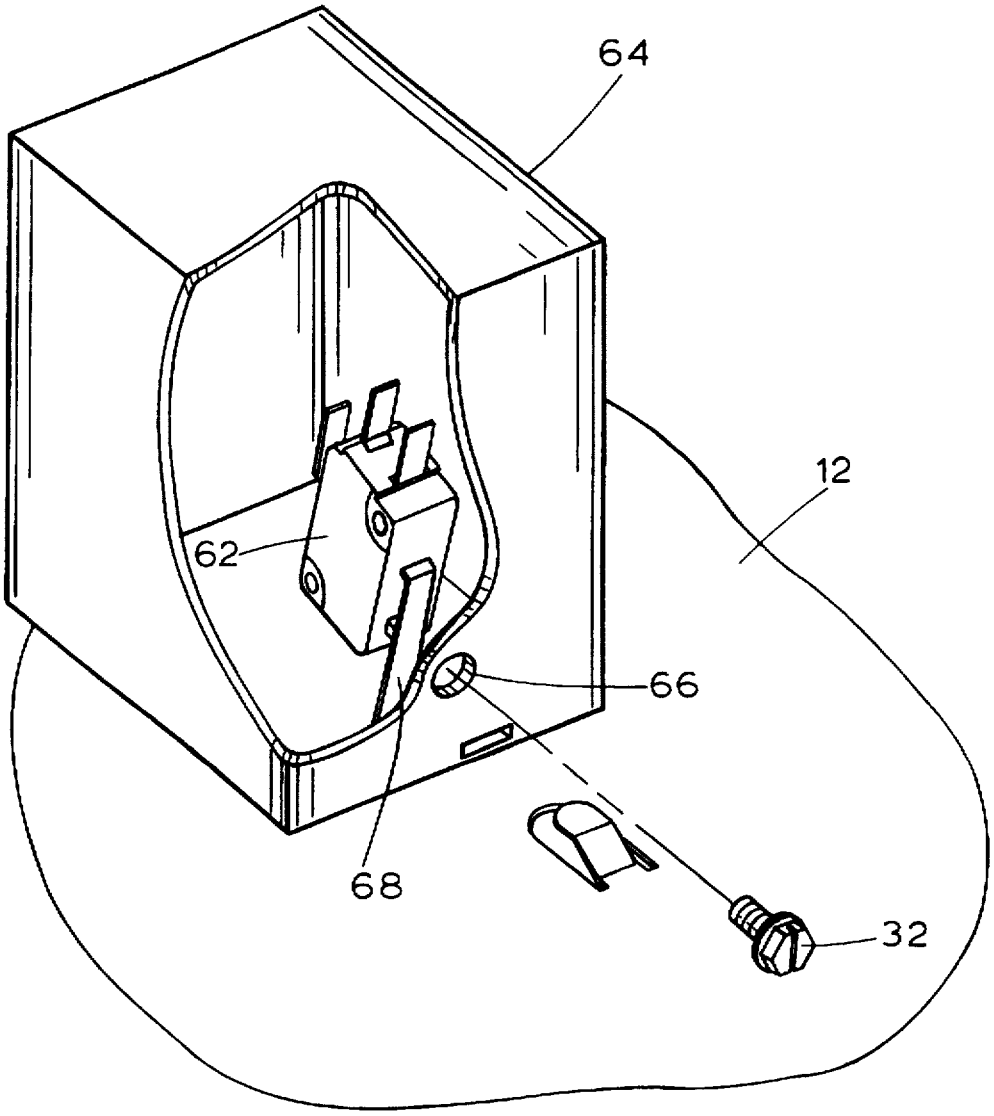
FIG. 6 shows the interlock switch of FIG. 3 in accordance with a second embodiment of the present invention.

A second embodiment of the present invention is shown in FIG. 6. This second embodiment includes an interlock switch 62 which is contained within a switch case 64. The switch case 64 is substantially closed and is suitably attached to the cabinet 12. When the fastener 32 is applied through the fastener receiving hole 40 so as to fasten the cover 22 to the cabinet 12, the fastener 32 also extends through a hole 66 in the switch case 64 to operate an actuating arm 68 of the interlock switch 62. Accordingly, the fastener 32 directly operates the actuator arm 68 of the interlock switch 62 in order to close the contacts of the interlock switch 62 when the fastener 32 has been applied to fasten the cover 22 to the cabinet 12.

When the fastener 32 is removed at the time that the cover 22 is removed from the cabinet 12, the actuating arm 68 is released allowing the switch contacts within the interlock switch 62 to open thus breaking the circuit from the power cord 20 to the microwave oven 10. Therefore, in this second embodiment, if the circuit breaker controlling the microwave oven 10 is not opened or if the fuse controlling the microwave oven 10 is not removed, power to the microwave oven 10 is still disconnected when the cover 22 is unfastened from the cabinet 12. Also, because the interlock switch 62 is housed in a switch case which is substantially closed, it is difficult for the inexperienced user to see well enough into the switch case 64 in order to determine how to close the interlock switch 62 while the cover 22 is removed from the microwave oven 10.

Figure 7:
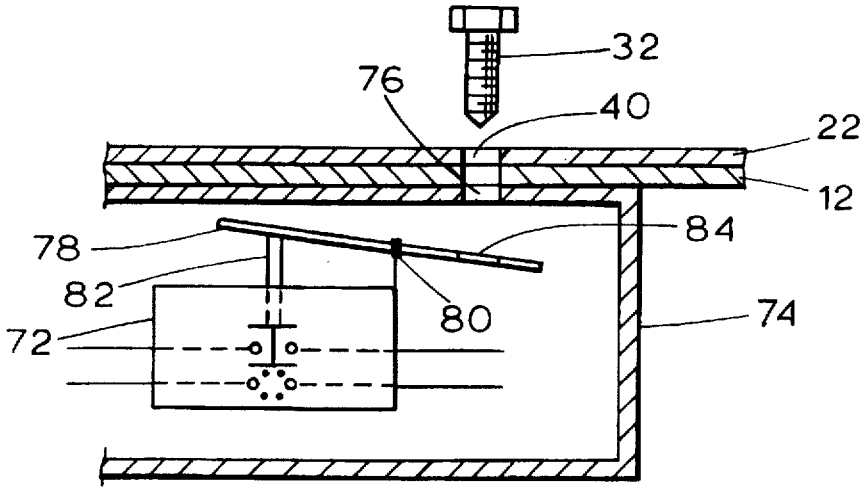
FIG. 7 shows the interlock switch of FIG. 3 in accordance with a third embodiment of the present invention.

A third embodiment of the present invention is shown in FIG. 7. This third embodiment includes an interlock switch 72 which is located within a switch case 74 that is suitably affixed to the cabinet 12. The switch case 74 has a hole 76 which is aligned with the corresponding fastener receiving hole 40 in the cabinet 12. The interlock switch 72 has an actuating arm 78 which pivots about a pivot point 80 and which cooperate with a switch plunger 82 to control the open and closed positions of the contacts of the interlock switch 72. The actuating arm 78 also has a hole 84 therethrough.

As shown in FIG. 7, when the fastener 32 is removed from the cover 22 and the cabinet 12, the spring in the switch case 74 opens the switch contacts of the interlock switch 72. Accordingly, the fastener 32 indirectly controls the interlock switch 72 through the actuating arm 78 to thereby interrupt power between the power cord 20 and the microwave oven 10. When the fastener 32 is reapplied to the cover 22 in order to attach the cover 22 to the cabinet 12, the fastener 32 threads through the hole 84 of the actuating arm 78. As the fastener 32 threads through the hole 84 of the actuator arm 78, the actuating arm 78 pivots counterclockwise about the pivot point 80 as viewed in FIG. 7 such that it operates through the switch plunger 82 in order to close the switch contacts of the interlock switch 72. Accordingly, power from the power cord 20 is reapplied to the microwave oven 10.

As is the case of all of the embodiments disclosed herein, the interlock switch 72 is housed in a switch case which is substantially closed. Accordingly, it is difficult for the inexperienced user to see well enough into the switch case 74 in order to discern how to close the interlock switch 72 while the cover 22 is removed from the microwave oven 10. Moreover, the action of the switch actuator 78 is opposite to what the inexperienced user would expect (i.e., the actuating arm 78 must be pulled instead of pushed in order to closed the interlock switch 72) which also makes it difficult for the inexperienced user to determine how to close the interlock switch 72 while the cover 22 is removed from the microwave oven 10.

Figure 8:
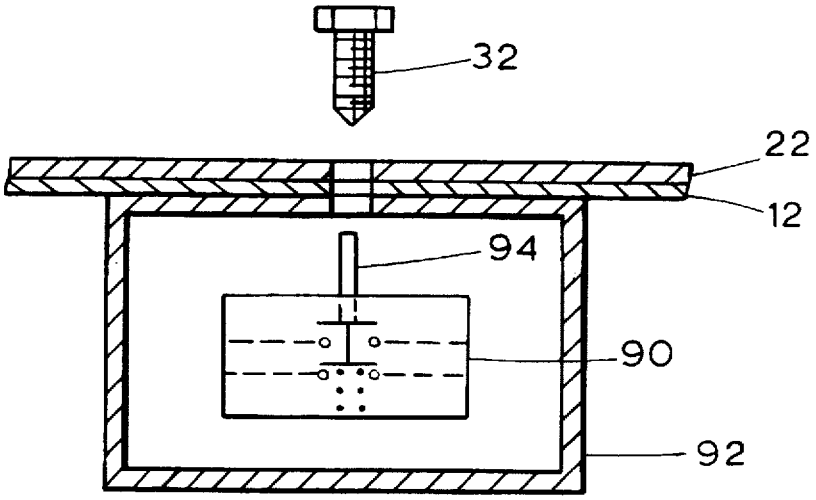
FIG. 8 shows the interlock switch of FIG. 3 in accordance with a fourth embodiment of the present invention.

A fourth embodiment of the present invention is illustrated in FIG. 8 and is similar to the second embodiment shown in FIG. 6. In this fourth embodiment, an interlock switch 90 is housed within a substantially closed switch case 92 which is suitably attached to the cabinet 12. The fastener 32, when it is operated to fasten the cover 22 to the cabinet 12, directly actuates a switch plunger 94 in order to close the interlock switch 90. When the fastener 32 unfastens the cover 22 from the cabinet 12, the force exerted on the switch plunger 94 by the fastener 32 is removed and the switch contacts of the interlock switch 90 are consequently allowed to open. Because the interlock switch 90 is housed in a switch case which is substantially closed, it is difficult for the inexperienced user to see well enough into the switch case 92 in order to discern how to close the interlock switch 90 while the cover 22 is removed from the microwave oven 10.

Figure 9:
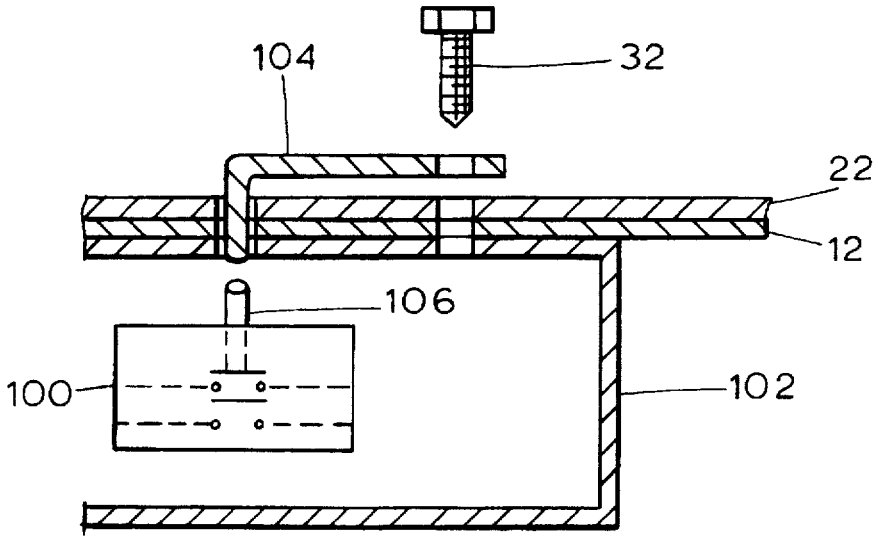
FIG. 9 shows the interlock switch of FIG. 3 in accordance with a fifth embodiment of the present invention; and, FIG. 10 shows a combination interlock switch which is similar to the interlock switch of FIGS. 3, 4, and 5 and which is in accordance with a sixth embodiment of the present invention.

A fifth embodiment of the present invention is illustrated in FIG. 9. In this fifth embodiment, an interlock switch 100 is suitably contained within a substantially closed switch case 102 which is suitably affixed to he cabinet 12 of the microwave oven 10. A switch operating arm 104 extends between the fastener 32 and a switch plunger 106 of the interlock switch 100. As the fastener 32 is turned to fasten the cover 22 to the cabinet 12, the fastener 32 passes through a hole of the switch operating arm 104 and depresses the switch operating arm 104 to close the interlock switch 100 through the switch plunger 106. When the fastener 32 is removed from the switch case 102, from the cabinet 12, from the cover 22, and from the switch operating arm 104, the switch operating arm 104 loses its support and dislodges from engagement with the switch plunger 106 and indeed drops away from the microwave oven 10 altogether. Thus, when the fastener 32 is removed, the fastener 32 indirectly operates the interlock switch 100 through the switch operating arm 104 to thereby interrupt power between the power cord 20 and the microwave oven 10.

Because the interlock switch 100 is housed in a switch case which is substantially closed, it is difficult for the inexperienced user to see well enough into the switch case 102 in order to discern how to close the interlock switch 100 while the cover 22 is removed from the microwave oven 10. Moreover, the holes through which the switch operating arm 104 extends in order to engage the switch plunger 106 may be slotted rather than round so as to prevent a screw or rod from engaging the switch plunger 106 thereby overriding the interlock switch 100. Furthermore, when the fastener 32 is removed from the cover 22, the switch operating arm 104 drops away from the microwave oven tending to convince the inexperienced user that the microwave oven 10 is broken to an extent where a qualified service representative is required.

Figure 10:
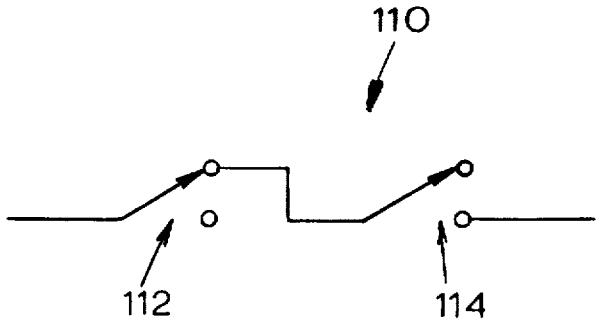

A sixth embodiment of the present invention is illustrated in FIG. 10. This embodiment may be similar to the first embodiment shown in FIGS. 4 and 5 or may be similar to any of the other embodiments of the present invention. As shown in FIG. 10, the interlock switch may comprise a plurality of switches, some of which may be normally open, some of which may be normally closed, and all of which are resettable. In the specific example of FIG. 10, a combination interlock switch 110 has a resettable normally closed switch 112 and a resettable normally open switch 114. The resettable normally closed switch 112 and the resettable normally open switch 114 are shown in the positions that they will have when the cover 22 is removed.

When the cover 22 is installed, the resettable normally closed switch 112 is closed and the resettable normally open switch 114 is closed. Accordingly, power is applied to the radiant energy emitters and control circuits of the microwave oven 10. When the cover 22 is removed, the resettable normally closed switch 112 remains closed and the resettable normally open switch 114 is open. Accordingly, power is removed from the radiant energy emitters and control circuits of the microwave oven 10 *Also, when the cover 22 is removed, the inexperienced user must reset only the resettable normally open switch 114 in order to defeat the combination interlock switch 110. If the inexperienced user also resets the resettable normally closed switch 112, power is still removed from the radiant energy emitters and control circuits of the microwave oven 10. Thus, because there is a combination of resettable switches, it is more difficult to defeat the interlock switch by resetting the correct combination of switches.

Certain modifications of the present invention have been discussed above. Other modifications will occur to those practicing in the art of the present invention. For example, as described above, the interlock switch of the present invention is illustrated at a location in the back of the microwave oven 10 and is opened when the back cover of the microwave oven 10 is removed. Alternatively, the interlock switch may be positioned at any location of the microwave oven 10 so that it is opened when any cover or case of the microwave oven 10 is removed.

Also, as discussed above, although the present invention has been specifically described in connection with a microwave oven, the present invention is useful in other types of electrical appliances such as refrigerators, ranges, laundry machines, heating and cooling products, televisions, computers, VCRs, power tools, etc., and may be used in conjunction with commercial, consumer, and/or industrial equipment.

In addition, although the interlock switches as described above open only one of the lines of the power cord 20, the interlock switches described above may be arranged to open all power lines of the power cord 20.

Moreover, other wires of the microwave oven 10 may be routed through the switch case 44 in order to make the interlock switch more confusing to the inexperienced user and to, thereby, make the defeat of the interlock switch less apparent.

Furthermore, although only two switches are shown in FIG. 10 for the combination interlock switch 110, more than two switches can be used in different arrangements.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. An interlock switch which opens when an appliance cover is removed comprising:

a switch, wherein the switch is arranged to control power to an appliance; and, removable fastening means for fastening a cover to the appliance, for holding the switch closed when the cover is fastened by the removable fastening means to the appliance, and for allowing the switch to open when the cover is unfastened from the appliance, wherein the removable fastening means is removable from both the cover and the appliance when the cover is unfastened from the appliance by the removable fastening means.

2. The interlock switch of claim 1 wherein the removable fastening means comprises a removable fastener which directly holds the switch closed when the cover is removable fastened by the fastener to the appliance and which directly allows the switch to open when the cover is unfastened from the appliance.

3. The interlock switch of claim 2 wherein the removable fastener is a threaded member which threads through the cover.

4. The interlock switch of claim 2 wherein the removable fastener is a threaded member, wherein the switch is encased in a switch case, wherein the switch case is affixed to the appliance, and wherein the switch case has an opening permitting the threaded member to extend through the opening of the switch case in order to hold the switch closed when the cover is removable fastened by the fastener to the appliance and to allow the switch to open when the cover is unfastened from the appliance.

5. The interlock switch of claim 1 wherein the removable fastening means comprises a removable fastener which indirectly holds the switch closed when the cover is removable fastened by the fastener to the appliance and which indirectly allows the switch to open when the cover is unfastened from the appliance.

6. The interlock switch of claim 5 wherein the removable fastening means comprises a lever between the removable fastener and the switch, wherein the lever has a pivot point, and wherein the lever moves around the pivot point in response to the removable fastener in order to hold the switch closed when the cover is fastened by the removable fastener to the appliance and to allow the switch to open when the cover is unfastened from the appliance.

7. The interlock switch of claim 6 wherein the removable fastener is a threaded member, wherein the lever has an opening on one side of the pivot point, wherein the lever actuates the switch on another side of the pivot point, and wherein the threaded member is arranged to threadably engage the opening of the lever so that, as the threaded member is threaded into the opening of the lever, the lever pivots to close the switch and so that, as the threaded member is threaded out of the opening of the level, the lever pivots to open the switch.

8. The interlock switch of claim 7 wherein the switch is encased in a switch case, wherein the switch case is affixed to the appliance, and wherein the switch case has an opening permitting an actuator, in response to the lever, to actuate the switch.

9. The interlock switch of claim 5 wherein the removable fastening means comprises an actuator arm, wherein the actuator arm is responsive to the removable fastener in order to actuate the switch, and wherein the actuator arm actuates the switch at a point which is offset from the removable fastener.

10. The interlock switch of claim 9 wherein the actuator arm has an actuating position in which it actuates the switch in response to the removable fastener fastening the cover to the appliance, and wherein the actuator arm is arranged to dislodge from the actuating position when the removable fastener is removed from the cover so that the switch is not again actuated when the removable fastener is reapplied to the cover unless the actuating arm is reinstated between the removable fastener and the switch.

11. The interlock switch of claim 10 wherein the switch is encased in a switch case, wherein the switch case is affixed to the appliance, and wherein the switch case has an opening permitting the actuating arm, in response to the removable fastener, to actuate the switch.

12. The interlock switch of claim 1 wherein the switch comprises:

a switch case;

an actuator within the switch case; and, a fastener opening through the switch case, wherein the switch is within the switch case, wherein the actuator controls the switch, wherein the removable fastening means is arranged to operate the actuator through the fastener opening in order to hold the switch closed when the removable fastening means fastens the cover to the appliance, wherein the actuator is arranged to open the switch when the fastening means is removed from the fastener opening, and wherein the switch cannot be closed by the removable fastening means through the fastener opening.

13. The interlock switch of claim 12 wherein the switch case has a reset opening, and wherein the actuator may be accessed through the reset opening so that the actuator may be operated to close the switch until the removable fastening means refastens the cover to the appliance whereby the removable fastening means is thus positioned to operate the actuator through the fastener opening so as to hold the switch closed.

14. The interlock switch of claim 13 wherein the switch case is affixed to the appliance.

15. The interlock switch of claim 1 wherein the switch comprises first and second switches, and wherein the first and second switches must be operated in a correct combination to permit power to flow therethrough.

16. An electrical appliance comprising:

an appliance base;

a cover;

power lines carrying electrical power to the appliance base;

a switch case, wherein the switch is affixed to the appliance base;

a switch within the switch case, wherein the switch is arranged to control the electrical power carried by the power lines, and wherein the switch has an open position and a closed position; and, a screw, wherein the screw is arranged to fasten the cover to the appliance base, and wherein the screw holds the switch in its closed position when the cover is fastened by the screw to the appliance base and allows the switch to move to its open position when the cover is not fastened by the screw to the appliance base.

17. The electrical appliance of claim 16 wherein the screw is arranged to directly hold the switch in its closed position when the cover is fastened by the screw to the appliance base and to directly allow the switch to move to its open position when the cover is not fastened by the screw to the appliance base.

18. The electrical appliance of claim 17 wherein the screw is a threaded member which threads through the cover to hold the switch in its closed position when the cover is fastened by the screw to the appliance base and to allow the switch to move to its open position when the cover is not fastened by the screw to the appliance base.

19. The electrical appliance of claim 17 wherein the screw is a threaded member, and wherein the switch case has an opening permitting the threaded member to extend through the opening of the switch case in order to hold the switch in its closed position when the cover is fastened by the screw to the appliance base and to allow the switch to move to its open position when the cover is not fastened by the screw to the appliance base.

20. The electrical appliance of claim 16 wherein the screw is arranged to indirectly hold the switch in its closed position when the cover is fastened by the screw to the appliance base and to indirectly allow the switch to move to its open position when the cover is not fastened by the screw to the appliance base.

21. The electrical appliance of claim 20 further comprising a lever between the screw and the switch, wherein the lever has a pivot point, and wherein the lever moves around the pivot point in response to the screw in order to hold the switch in its closed position when the cover is fastened by the screw to the appliance base and to allow the switch to move to its open position when the cover is not fastened by the screw to the appliance base.

22. The electrical appliance of claim 21 wherein the screw is a threaded member, wherein the lever has an opening on one side of the pivot point, wherein the lever actuates the switch on another side of the pivot point, and wherein the threaded member is arranged to threadably engage the opening of the lever so that, as the threaded member is threaded into the opening of the lever, the lever pivots to close the switch and so that, as the threaded member is threaded out of the opening of the lever, the lever pivots to open the switch.

23. The electrical appliance of claim 22 wherein the switch case has an opening permitting an actuator, in response to the lever, to actuate the switch.

24. The electrical appliance of claim 20 further comprising an actuator arm, wherein the actuator arm is responsive to the screw in order to actuate the switch, wherein the actuator arm is between the actuator and the screw and wherein actuator actuates the switch at a point which is offset from the screw.

25. The electrical appliance of claim 24 wherein the actuator arm has an actuating position in which it actuates the switch in response to the screw fastening the cover to the appliance base, and wherein the actuator arm is arranged to dislodge from the actuating position when the screw is removed from the cover so that the switch is not again actuated when the screw is reapplied to the cover unless the actuating arm is reinstated between the actuator and the screw.

26. The electrical appliance of claim 25 wherein the switch case has an opening permitting the actuating arm, in response to the screw, to actuate the switch.

27. The electrical appliance of claim 16 further comprising an actuator within the switch case to control the switch, wherein the switch comprises a fastener opening through the switch case, wherein the screw is arranged to operate the actuator through the screw opening in order to close the switch when the screw fastens the cover to the appliance base, wherein the actuator is arranged to open the switch when the screw is removed from the fastener opening, and wherein the switch cannot be reset by the screw through the fastener opening.

28. The electrical appliance of claim 27 wherein the switch case has a reset opening, and wherein the actuator may be accessed through the reset opening so that the actuator may be operated to close the switch until the screw refastens the cover to the appliance base whereby the screw is thus positioned to operate the actuator through the fastener opening so as to hold the switch closed.

29. The electrical appliance of claim 16 wherein the switch comprises first and second switches, and wherein the first and second switches must be operated in a correct combination to permit power to flow therethrough.

30. An interlock switch which opens when an appliance cover is removed comprising:

a switch case having a fastener opening;

a switch, wherein the switch is within the switch case, wherein the switch has an open position and a closed position, and wherein the switch is arranged to supply power to an appliance when the switch is in its closed position;

an actuator within the switch case, wherein the actuator is arranged to control the switch, and wherein the actuator is not viewable through the fastener opening when the switch is in its open position; and, a fastener, wherein the fastener is arranged to operate the actuator through the fastener opening in order to hold the switch in its closed position when the fastener fastens a cover to an appliance base, and wherein the actuator is arranged to allow the switch to move to its open position when the fastener is removed from the fastener opening.

31. The interlock switch of claim 30 wherein the fastener is a threaded member which threads through the cover to hold the switch in a closed position.

32. The interlock switch of claim 30 wherein the fastener is a threaded member, and wherein the switch case has an opening permitting the threaded member to extend through the opening of the switch case in order to hold the switch in a closed position.

33. The interlock switch of claim 30 wherein the switch case has a reset opening, and wherein the actuator may be accessed through the reset opening so that the actuator may be operated to close the switch until the fastener refastens the cover to the appliance base whereby the fastener is thus positioned to operate the actuator through the fastener opening so as to hold the switch closed.

34. The interlock switch of claim 33 wherein the fastener is a threaded member which threads through the cover to hold the switch in a closed position.

35. The interlock switch of claim 33 wherein the fastener is a threaded member, and wherein the switch case has an opening permitting the threaded member to extend through the opening of the switch case in order to hold the switch in a closed position.

* * * * *